United States Patent [19]

Camp et al.

[11] 4,170,201

[45] Oct. 9, 1979

[54] DUAL MODE HYBRID CONTROL FOR ELECTRONIC FUEL INJECTION SYSTEM

[75] Inventors: John Camp, Birmingham; Alvin D. Toelle, Fenton; Gene Y. Wen, Troy, all of Mich.

[73] Assignee: The Bendix Corporation, Southfield, Mich.

[21] Appl. No.: 802,201

[22] Filed: May 31, 1977

[51] Int. Cl.[2] ..... F02B 3/00; F02B 75/10

[52] U.S. Cl. ..... 123/32 EE; 123/32 EH; 123/119 EC; 60/276; 60/285

[58] Field of Search ..... 123/32 EE, 32 EH, 32 EA, 123/119 EC; 60/276, 285

[56] References Cited

U.S. PATENT DOCUMENTS

| | | | |
|---|---|---|---|
| 3,704,591 | 12/1972 | Tatsutomi | 60/285 |
| 3,919,983 | 11/1975 | Wahl et al. | 123/32 EE |
| 3,939,654 | 2/1976 | Creps | 60/285 |
| 3,948,228 | 4/1976 | Luchaco | 123/32 EE |
| 3,986,352 | 10/1976 | Casey | 60/276 |
| 3,990,411 | 11/1976 | Oberstadt et al. | 60/276 |
| 3,998,189 | 12/1976 | Aoki | 60/276 |

*Primary Examiner*—Charles J. Myhre
*Assistant Examiner*—P. S. Lall
*Attorney, Agent, or Firm*—Russel C. Wells; William A. Marvin

[57] ABSTRACT

A dual mode control system for operating an electronic fuel injection system for an internal combustion engine so as to achieve an optimal compromise between engine emissions, fuel economy and driveability. A closed loop control circuit is provided which senses the amount of oxygen in the engine exhaust and normally drives an integrator in a closed loop mode of operation to operate the electronic fuel injection system at the stoichiometric air/fuel ratio at which the best conversion efficiency of hydrocarbons, carbon monoxide and nitrous oxides occur. An open loop control circuit senses high speed operation where hydrocarbons and carbon monoxide conversion are normally high and where nitrous oxide emission is not critical and clamps the output of the integrator to a predetermined value which operates the electronic fuel injection system at a nonstoichiometric, relatively lean, air/fuel ratio for improved fuel economy. Further open loop control circuitry may be provided to sense very low speed, low engine load operation where nitrous oxide emission is negligible for similarly switching to an open loop mode of operation with the integrator output clamped. An override circuit may be provided which senses engine acceleration which normally requires a relatively rich air/fuel ratio for good driveability and overrides the clamped integrator output to restore the closed loop mode of operation regardless of the engine speed thereby achieving an optimal compromise between engine emissions, fuel economy and drivability.

29 Claims, 3 Drawing Figures

+V
+V
+V
+V
+V

DUAL MODE HYBRID CONTROL FOR ELECTRONIC FUEL INJECTION SYSTEM

BACKGROUND OF THE INVENTION

1. Field of The Invention

This invention relates to electronic fuel injection systems and more particularly to a dual mode hybrid control system for operating electronic fuel injection systems so as to achieve an optimal compromise between engine emissions, fuel economy and driveability.

2. Description of The Prior Art

The ever-increasing number of automobiles on our streets and highways, particularly in urban areas, has caused a growing concern because of the pollution caused in part by automobile exhaust fumes. This has led to increased emphasis on ways for reducing undesirable exhaust emissions such as unburned hydrocarbons, carbon monoxide and nitrous oxides. Acting on this concern, the government has established increasingly stringent requirements for improved control of air/fuel ratios for automobile engines in an attempt to reduce or eliminate harmful exhaust emissions.

The air/fuel ratio of an internal combustion engine, i.e. the amount of air drawn into a engine in relation to the amount of fuel supplied thereto, ideally should be maintained at values which, for all possible phases of engine operation, will prevent or eliminate exhaust emissions of unburned fuel and other by-products of combustion from exceeding predetermined levels. If the air/fuel ratio is less than that value which will present an amount of fuel which will be essentially completely consumed during combustion, then a wasteful surplus of fuel together with undesirable products of incomplete combustion will be discharged into the atmosphere through the engine's exhaust system in the form of pollution.

One of the most commercially feasible means for reducing emissions is the well-known three-way catalyst which greatly reduces exhaust emissions. The three-way catalyst has the best conversion efficiency of hydrocarbons, carbon monoxide and nitrous oxide when the engine is operating in a narrow window of air/fuel ratios near the stoichiometric air/fuel ratio.

However, a more recent problem thought to be at least as important by many members of our society, concerns the alarming fuel shortage existing in the world today and our need to conserve fuel and operate at peak fuel efficiency. It has been found, however, that for best fuel economy, the air/fuel ratio is required to be leaned out to the general range of 16 to 1 to 18 to 1. Furthermore, good drivability requires that the air/fuel ratio be set relatively rich during acceleration operation. Therefore, we are faced with the dilemma of having to chose between maximum reduction of engine emissions, maximum fuel economy, or optimal or at least acceptable drivability.

Most of the techniques of the prior art for controlling air/fuel ratios have addressed only one of these problems. Various complex mechancal and electrical means have been devised to substantially reduce engine emissions. Still other complex mechanical and electrical systems have been devised in an attempt to improve fuel economy. Most of these systems are extremely complex, expensive, mechancally prone to malfunction or fail and do not attempt to address the several critical problems which must be faced in today's society.

Those of the prior art who have recognized even some aspects of these problems have employed extremely expensive and complex computer controlled systems and the like in an attempt to solve these many faceted problems. Such solutions are not commercially feasible. None of the prior art patents have produced a commercially feasible, relatively simple, inexpensive system for obtaining an optimal compromise between engine emissions, fuel economy and drivability.

The present invention avoids the difficulties of the prior art and provides a relatively inexpensive, mechanically simple, failure-free, dual mode control circuit for operating an electronic fuel injection system so as so achieve an optimal compromise between engine emissions, fuel economy and drivability.

SUMMARY OF THE INVENTION

The present invention provides a dual mode hybrid control system for controlling the operation of an electric fuel injection system for an internal combustion engine operable at different rotational speeds. The control system includes means for generating an electrical control signal for controlling the operation of the electronic fuel injection system. A closed loop comparator means is coupled to the control signal generating means for establishing a closed loop control mode of operation which enables the signal generating means to normally operate the electronic fuel injection system at near the stoichiometric air/fuel ratio while the engine operates within a predetermined range of driving speeds to achieve an optimal reduction of engine emissions. An open loop comparator means is coupled to the control signal generating means and is responsive to the attainment of a driving speed outside of the predetermined range for switching to an open loop control mode of operation for clamping the output of the signal generating means to operate the electronic fuel injection system at a predetermined lean air/fuel ratio for improved fuel economy.

In the preferred embodiment, the closed loop control system includes an oxygen sensor for sensing the quantity of oxygen present in the engine exhaust and means for generating an electrical signal indicative thereof. An integrator circuit receives this signal and operates the electronic fuel injection system within the desired optimal emission-reducing window near the stoichiometric air/fuel ratio.

The integrator circuit of the closed loop path includes a normally non-conductive transistor switch coupled across the integrating capacitor of the circuit. A second comparator means may include a single comparator having one input coupled to a source of signals indicative of the engine speed and the other input connected to means for establishing a engine speed threshold corresponding to a predetermined driving speed. When the engine speed is below the threshold speed, the output of the comparator maintains the switching transistor in its normally non-conductive state so that the integrator operates in the closed loop mode but when the engine speed exceeds the threshold value, the output of the comparator switches the transistor to a conductive state thereby switching the integrator to an open loop mode of operation which clamps the integrator output to a predetermined level of voltage for operating the electronic fuel injection system at a predetermined non-stoichiometric relatively lean air/fuel ratio for better fuel economy. The second input of the integrator may be connected to means for selecting the predetermined level of voltage to which the output is clamped during the open loop mode of operation.

In an alternative embodiment, the second comparator means may include a pair of comparators for establishing a range of speeds. So long as the engine speed is between or within the range, the integrator operates in the closed loop mode but when the engine speed fall below a low speed threshold or rises above a high speed threshold, the output of the comparator means switches the transistor to a conductive state thereby switching the integrator to the open loop mode of operation thereby clamping the integrator output to the predetermined level of voltage.

Circuitry may also be provided for sensing engine acceleration. When the acceleration exceeds a predetermined value, a signal is generated for overriding the output of the second comparator means to restore the switching transistor to its normally non-conductive state thereby unclamping the output of the integrator and restoring the close loop mode of operation so that the electronic fuel injection system is operated at the stoichiometric air/fuel ratio regardless of driving speed.

The present invention provides an extremely simple, relatively inexpensive, highly reliable, dual mode control system for operating an electronic fuel injection system so as to obtain an optimal compromise between engine emissions, fuel economy and driveability and provides means whereby one or more of these features may be traded off at the expense of the other to meet the needs of a particular driving situation or changing government standards.

Other advantages and meritorious features of the present invention will be more fully understood from the following description of the drawings and the preferred embodiments, the appended claims and the drawings which are briefly described herein below.

DESCRIPTION OF THE PREFERRED EMBODIMENT

Figure 1:
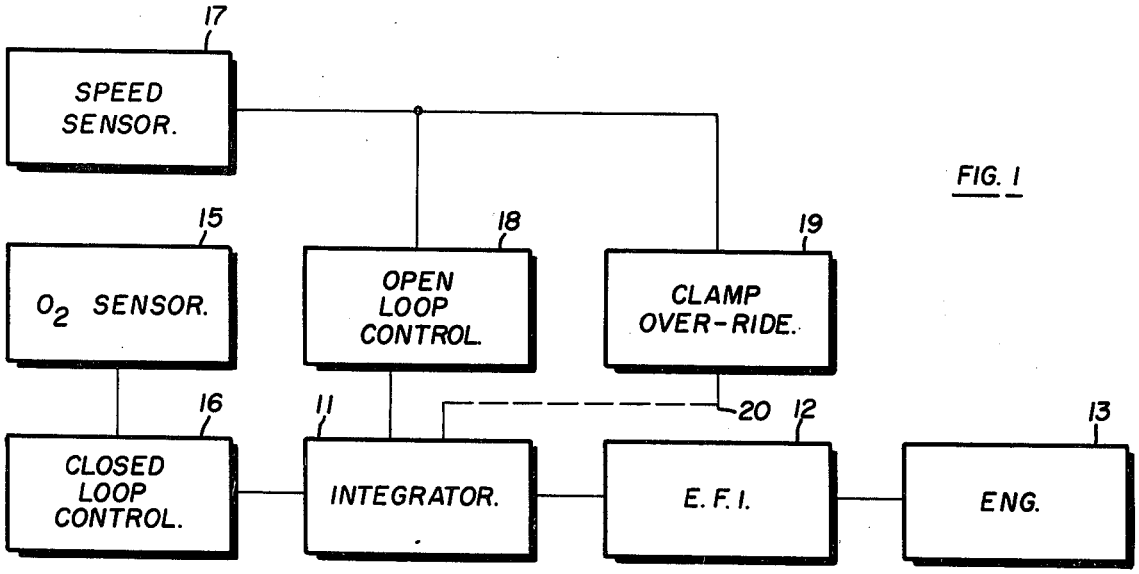
FIG. 1 is a block diagram illustrating the dual mode hybrid control system of the present invention.

The block diagram of FIG. 1 illustrates the dual mode control system of the present invention. The output of the integrator circuitry of block 11 is used to operate a conventional electronic fuel injection system as represented by block 12 so as to control the supply of fuel and hence the ratio of fuel to air provided to the engine represented by block 13. A closed loop is established from the engine exhaust where a circuit, represented by block 15, for sensing the quantity or amount of oxygen in the exhaust generates an electrical signal indicative thereof and supplies this signal back to a comparator of a closed loop control represented by block 16. The closed loop includes the oxygen sensor of block 15, the closed loop control of block 16, the integrator 11, and the electronic fuel injection system 12. The closed loop is used to operate the electronic fuel injection system of block 12 in a window near the stoichiometric air/fuel ratio which achieves the best or optimal conversion efficiency of hydrocarbons, carbon monoxide and nitrous oxides as hereinafter described.

An open loop control system 18 is also provided. A circuit 17 is provided for sensing the speed of the engine by any conventional means such as a tachometer measuring engine revolutions or by means of air flow monitoring or the like. The speed sensor of block 17 transmits electric signals indicative of the engine speed back to the open loop control circuit of block 18 and this circuit will respond to certain engine speed conditions to cause the integrator of block 11 to switch from a closed loop mode of operation to an open loop mode of operation whereby the electronic fuel injection system of block 12 is controlled by a predetermined level of voltage causing it to operate at a predetermined, non-stoichiometric, relatively lean air/fuel ratio generally in the range of 16–18 to 1.

A clamp override circuit 19 is provided which senses engine acceleration by any conventional means and overrides the open loop control of circuit 18 to operate the integrator 11 in the closed loop mode at the stoichiometric air/fuel ratio regardless of the engine speed. Since the clamp override circuit of block 19 is optional, a dotted path 20 is shown connecting the clamp override circuit of block 19 with the integrator circuitry of block 11.

A first embodiment of the dual mode hybrid control system of the present invention will now be described with reference to FIG. 2. The integrator circuit of block 11 includes an operational amplifier 21 having its positive input connected to an input node 22, its negative input connected to an input node 23 and its integrator output connected to a node 24. Output node 24 is connected via lead 25 to the electronic fuel injection system of block 12 to control the operation thereof as conventionally known. The negative input node 23 is connected directly to a node 26 and the integrator output node 24 is connected directly to a node 27. An integrating capacitor 28 is connected between nodes 26 and 27. The series combination of a resistor 29 and an FET transistor 30 is connected in parallel across capacitor 28 between nodes 26 and 27 such that one of the current-carrying electrodes of FET 30 is connected to node 26 and the other current-carrying electrode of FET 30 is connected to one end of resistor 29 while the opposite end of the resistor 29 is connected to the node 27. The gate electrode of FET 30 is connected directly to a switching control node 31 and FET transistor 30 is normally maintained in a non-conductive state so as to allow the integrator of block 11 to operate in the closed loop control mode.

The positive input node 22 of the operational amplifier 21 is connected to a source of potential through resistor 32 and simultaneously through a variable resistor 33 to ground. The variable resistor 33 may be trimmed or adjusted so as to set the clamped voltage at the output 24 of the integrator to a predetermined voltage level sufficient to operate the electronic fuel injection system of block 12 at the desired, predetermined, non-stoichiometric, relatively lean air/fuel ratio in the range of 15–19 to 1 for optimal fuel economy.

The closed loop control circuitry of block 16 includes a comparator 33 having its negative input connected through a resistor 34 to the output of the oxygen sensor circuitry of block 15 for receiving electrical signals via lead 35 indicative of the amount of oxygen present in the engine exhaust for control purposes. The positive input of the comparator 33 is directly connected to an input node 36. Node 36 is connected through a resistor 37 to a source of potential and simultaneously through a variable resistor 38 to ground. The variable resistor 38 may be used to trim or adjust the threshold value of the comparator 33 so that the signal indicative of the oxygen level arriving at the negative input will cause the comparator 33 to output a signal depending upon whether or not the level of oxygen is above or below the value determined by the value of resistor 38. The output of comparator 33 is connected directly to a resistor 39 which is connected via lead 40 to the negative input node 23 of the operational amplifier 21 of the integrator circuitry of block 11.

In operation, the signal output by the oxygen sensor of block 15 will be supplied by a lead 35 to comparator 33 which will output a signal which drives the output of the integrator up and down according to the oxygen sensor output. This closed loop control mode of operation will constantly vary the integrator output so as to maintain the narrow band of air/fuel ratios necessary to operate the three-way catalyst at its peak efficiency at the stoichiometric air/fuel ratio thereby ensuring the most efficient conversion of hydrocarbons, carbon monoxide and nitrous oxides.

The open loop control system of block 18 includes a comparator 41 having its negative input connected directly to a resistor 42. The resistor 42 is connected via lead 43 to the output 62 of the speed sensor circuit of block 17 and receives electrical signals indicative of the speed of the engine 13, as conventionally known. Preferably, the engine speed signal is a voltage representative of engine speed which decreases with increasing engine speed. The positive input of the comparator 41 is connected directly to an input node 44. Node 44 is connected to a source of potential through a resistor 45 and simultaneously through a variable resistor 46 to ground. The variable resistor 46 may be selectively varied or trimmed so as to establish a threshold speed limit so that the comparator 41 will have a high output whenever the engine speed exceeds the limit established by the setting of the resistor 46 and will have a low output whenever the engine speed is below the limit established by the setting of the resistor 46. The output of comparator 41 is connected directly to a resistor 47 which is connected to the anode of a diode 48 whose cathode is connected via lead 49 to the switching control node 31.

In operation, when the voltage signal supplied by the speed sensor circuitry 17, which may be any signal representing RPM or air flow or the like that represents engine speed, is fed to the negative terminal of the comparator 41, it is compared to the speed threshold determined by the signal present at the positive input as established by the setting of resistor 46. The speed threshold corresponds to a driving speed above which NOx conversion is no longer critical. If the engine speed is below the threshold level which may be, for example, 40 miles an hour, the output of comparator 41 will be low. When this low signal is transmitted via lead 49 to transistor control node 31, it will continue to maintain the FET transistor 30 in the non-conductive state thereby enabling the integrator of block 11 to continue operating in the closed loop control mode so that the electronic fuel injection system of block 11 is operated at the optimal emission-reducing stoichiometric air/fuel ratio.

If however, the engine speed exceeds the threshold level established by resistor 46, the output of comparator 41 will go high. When this high signal is transmitted via lead 49 to the switching control node 31, switching transistor 30 will be switched to a conductive state so as to cause the integrator of block 11 to switch from the closed loop mode of operation to the open loop mode of operation and clamp the output 24 of the integrator 11 at the predetermined level of voltage established by resistor 33. Therefore, the predetermined voltage level output from the integrator via lead 25 to the electronic fuel injection system of block 12 will operate the electronic fuel injection system 12 at the desired, predetermined, nonstoichiometric relatively lean air/fuel ratio in the desired range for optimal fuel economy.

The clamp override circuitry of block 19 is optional and may be used to improve drivability. While any type of circuit capable of sensing engine acceleration, such as by sensing air flow, manifold pressure or the like may be used, the present example utilizes a differentiator circuit for sensing speed control signals. An electrical differentiator circuit 50 includes an operational amplifier 51 having one input connected directly to ground through a lead 52, a second input connected directly to an input node 53 and an output connected directly to an output node 54. Input node 53 is connected directly to a node 55 while output node 54 is connected directly to a node 56. A resistor 57 is connected directly between nodes 55 and 56 and a capacitor 58 is connected in parallel across resistor 57 between nodes 55 and 56, as conventionally known. Input node 53 is connected through a differentiating resistor 59 to one plate of a differentiating capacitor 60 whose opposite plate is connected via lead 61 to the output of the circuit of block 17 which provides electrical signals indicative of the engine speed thereto via input terminal 62.

The output node 54 is connected through a resistor 63 to the positive input of a comparator 64. The negative input of the comparator 64 is connected directly to an input node 65. Input node 65 is connected to a source of potential through a resistor 66 and simultaneously is connected to ground through a variable resistor 67. The variable resistor 67 may be adjusted or trimmed so as to establish a threshold acceleration level at the input of the comparator 64 so that the comparator 64 may output a low signal whenever the acceleration of the engine is below the established acceleration threshold level and a high signal whenever the engine acceleration is above the threshold level. The output of the comparator 64 is connected through a resistor 68 to the anode of a diode 69 whose cathode is connected directly to the gate or trigger electrode of an FET switching transistor 70 having one current-carrying electrode connected directly to ground and the other current-carrying electrode connected via lead 71 to the transistor switching control node 31.

In operation, the clamp override circuitry of block 19 will be described briefly as follows. The electrical signals indicative of the engine speed are received at input node 62 from the speed sensor circuitry of block 17 and supplied via lead 61 to the differentiator 50. The speed signals are differentiated and the output is supplied through resistor 63 to the positive input of comparator 64. The differentiated speed signal represents the rate of change of the engine speed or the engine acceleration. If the acceleration is less than the threshold value determined by the setting of variable resistor 67, the output of comparator 64 is low and FET 70 remains in a non-conductive state.

If, however, engine acceleration exceeds the threshold value determined by resistor 67, the output comparator 64 goes high and this high is transmitted via resistor 68 and diode 69 to the gate of the FET transistor 70 causing it to switch to a conductive state so as to complete a current path between ground and switching control node 31 via lead 71. If a low signal was supplied from the output of comparator 41 via lead 49, nothing happens and the switching transistor 30 remains in a non-conductive state to ensure that the integrator circuit of block 11 continues to operate in the closed loop mode. If however a high is present at the output of comparator 41, indicating that the engine speed is above the predetermined threshold value determined by the setting of resistor 46, then the high signal is diverted to ground via lead 49, node 31, lead 71 and the conducting FET transistor 70 so that the switching transistor 30 is restored to its normally non-conducting state to unclamp the output 24 of the integrator circuit 11 and restore the closed loop mode of operation regardless of engine speed thereby ensuring good drivability during engine acceleration.

The operation and advantages of the dual mode hybrid control system of the present invention will be briefly summarized herebelow. The object of the dual mode control circuit of the present invention is to provide an arrangement to operate the electronic fuel injection system either at near the optimal emission-reducing stoichiometric air/fuel ratio under closed loop control or under a relatively lean air/fuel ratio in the range of 16–18 to 1 under open loop control depending on the vehicle speed and the engine operating mode. By selecting the proper range of speed and acceleration rate to operate the engine in closed loop control, the best compromise between engine emission, fuel economy and drivability can be achieved.

The three-way catalyst presently employed in internal combustion engines offers the best conversion efficiency of hydrocarbons, carbon monoxide and nitrous oxide when operating at the stoichiometric air/fuel ratio. Therefore, an oxygen sensing closed loop control is required to maintain the narrow band of the air/fuel ratio variation to operate the three-way catalyst at its peak efficiency. If the air/fuel ratio is leaned out to be within the 16 to 18 range, the three-way catalyst still has good conversion of hydrocarbons and carbon monoxide but nitrous oxide conversion will be reduced. For the best fuel economy, however, the air/fuel ratio is required to be set in the relatively lean range of 16–18 to 1. Furthermore, for good drivability, the air/fuel ratio is required to be set relatively rich or at least not relatively lean during acceleration operation. Therefore, the best compromise among exhaust emission, fuel economy and drivability are achieved by the present invention in the following manner.

When the internal combustion engine is being operated in an urban area, the speed of the engine is relatively low and the reduction of nitrous oxide emission is of critical importance because of the high density of vehicle population. The comparator circuitry of block 18 is designed to detect low speed urban driving such as below 30 or 40 miles an hour, as determined by the setting of variable resistor 46, so that the electronic fuel injection system is operated in a closed loop control mode by the oxygen sensing circuitry of block 15, the comparator circuitry of the closed loop control of block 16, and the integrator circuitry of block 11. When the comparator 41 of block 18 detects high speed rural driving, by a comparison showing that the current engine speed exceeds the value of 30 or 40 miles per hour selected by resistor 46, the output of comparator 41 goes high to switch on transistor 30 and to initiate operation in the open loop control mode and clamp the output of the integrator circuit of block 11 so that a predetermined level of control voltage is supplied to the electronic fuel injection circuit of block 12 to maintain an air/fuel ratio in the range of 16–18 to 1 to achieve improved fuel economy.

The differentiator circuitry 50 of block 19 differentiates the speed control signals supplied by block 17 and detects engine acceleration. Comparator 64 determines when the engine acceleration exceeds a predetermined threshold value, determined by the setting of resistor 67, and when a predetermined value of acceleration is exceeded, the output of comparator 64 will switch the FET transistor 70 on to complete a current path between the switching control node 31 and ground so as to restore operation to the closed loop control mode and unclamp the output of the integrator 11 regardless of the vehicle speed thereby improving drivability.

Figure 2:
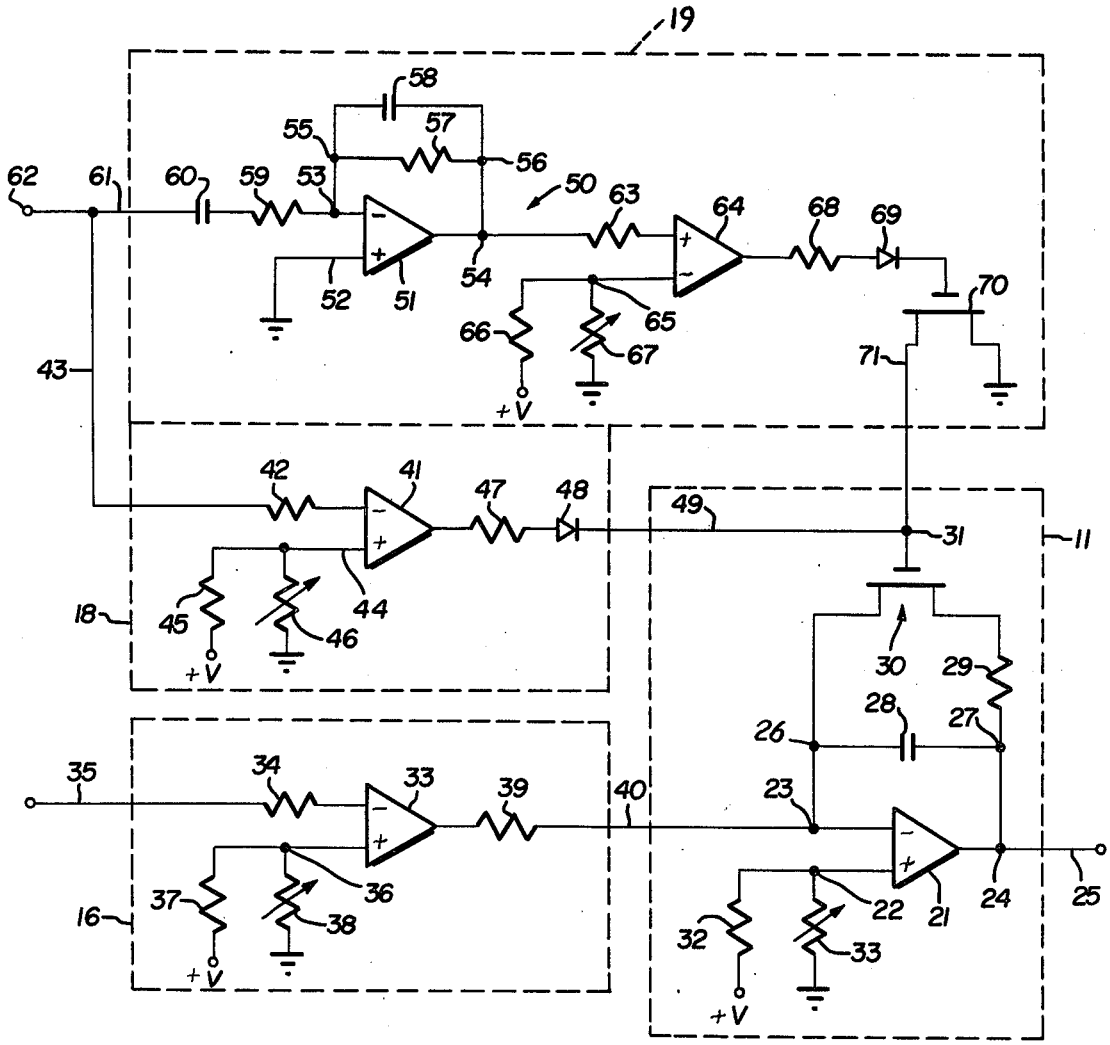
FIG. 2 is a schematic diagram of one embodiment of the dual mode control system of the present invention utilizing a single speed threshold determining means.
Figure 3:
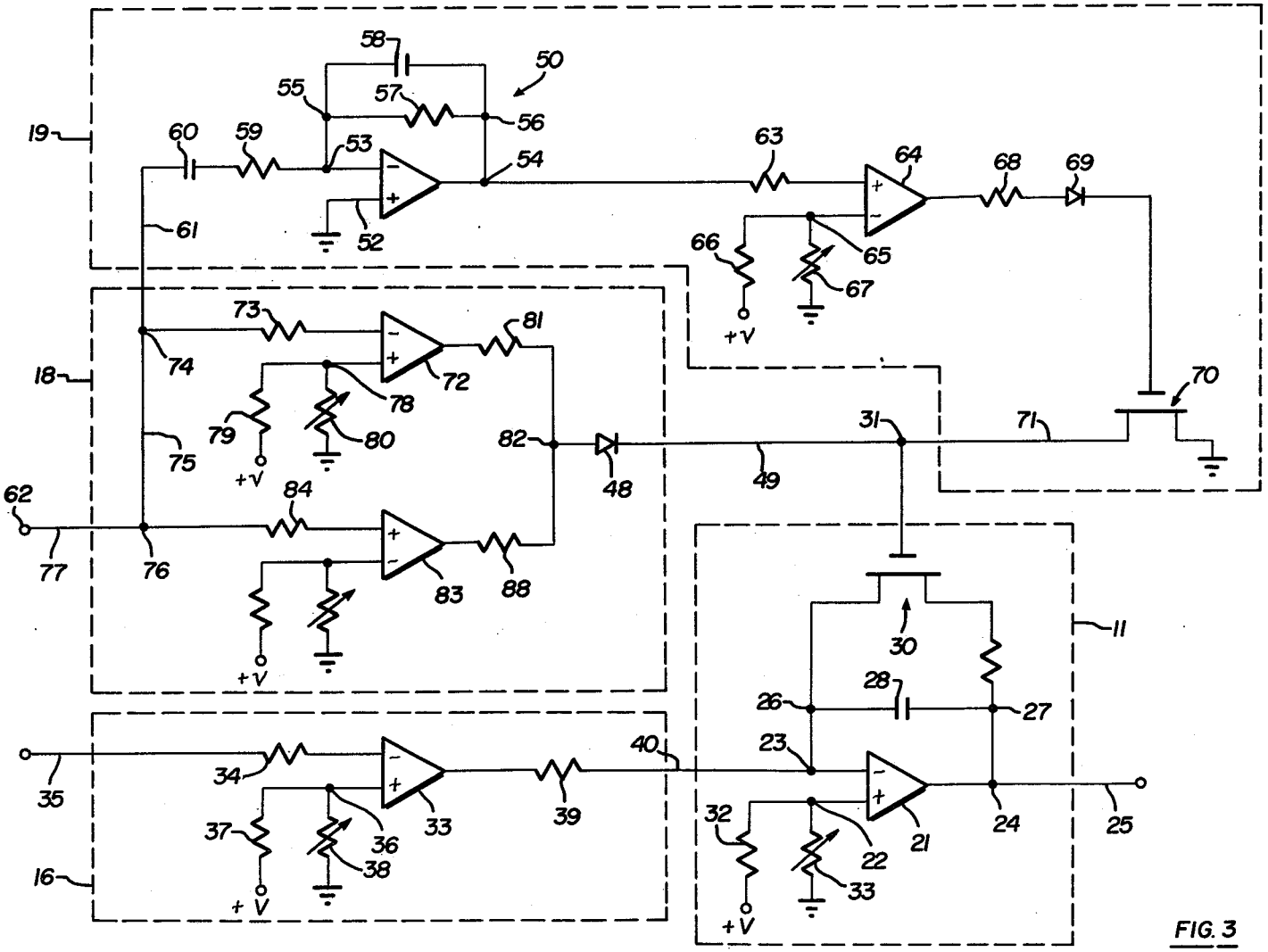
FIG. 3 is a schematic diagram of another embodiment of the dual mode control system of the present invention wherein controlled operation inside and outside of a range of engine speeds is accomplished.

FIG. 3 is a schematic diagram of another embodiment of the dual mode control circuit of FIG. 2 and like reference numerals correspond to similarly designated elements. The integrator circuitry of block 11, the comparator circuitry of the closed loop control of block 16, and the clamp override circuitry of block 19 are identical to that of FIG. 2 and the previous description applies thereto. The circuitry of block 18 has been modified to provide for open loop control outside a predetermined range or band of engine speeds.

A first or low speed comparator 72 has its negative input connected to one end of a resistor 73 whose opposite end is connected to a node 74. Node 74 is connected through lead 61 to serve as an input to the differentiator capacitor 60 of the clamp override circuit of block 19 and is connected via lead 75 to a node 76. Node 76 is connected via lead 77 to the input terminal 62 which receives the electrical signals indicative of the engine speed from the output of the speed sensor circuitry of block 17 as previously described.

The positive input to comparator 72 is connected directly to an input node 78. Node 78 is connected through a resistor 79 to a source of positive potential and through a variable resistor 80 to ground. The variable resistor 80 may be adjusted or trimmed so as to set the predetermined low speed threshold or limit, such as 20 miles per hour, for example, which establishes the lower end of the speed range being monitored. If the engine speed, as represented by the signal being supplied to the negative input of comparator 72 via resistor 73 is greater than the low speed limit or threshold value established by resistor 80, then the output of comparator 72 is low and if the value of the speed voltage present at the negative input of comparator 72 is less than the low speed limit or threshold established by resistor 80, then the output of comparator 72 goes high.

The output of comparator 72 is connected through a resistor 81 to a comparator output node 82. Node 82 is connected to the anode of a diode 48 whose cathode is connected via lead 49 directly to the switching transistor control node 31, as previously described. If a low signal is supplied from the output of comparator 72 to the control node 31, transistor 30 remains in its normally non-conductive state and the integrator circuitry 11 continues to operate in the closed loop mode of operation. If, however, a high is outputted from comparator 72 and supplied to control node 31, the switching transistor 30 becomes conductive to switch the operation of the integrator circuitry 11 to an open loop control mode thereby clamping the output 24 of the integrator 11 to a predetermined level of voltage established by resistor 33 for operating the electronic fuel injection system 12 at the relatively lean air/fuel ratio range of 16–18 to 1 for optimal fuel economy.

Similarly, a second or high speed limit comparator 83 has its positive input connected through a resistor 84 to input node 76 for receiving the speed indicative signals from input terminal 62. The negative input of comparator 63 is connected directly to an input node 85. Node 85 is connected to a source of positive potention through a resistor 86 and is connected through a variable resistor 87 to ground. Variable resistor 87 may be selectively adjusted or trimmed so as to establish a predetermined high-speed limit or threshold of engine speed above which it is desired to operate in the open loop control mode. When the engine speed, as indicated by the signals arriving at the positive input of comparator 83 is below the high-speed limit, such as 50 miles an hour or the like, which is established by the setting of the variable resistor 87, the output of comparator 83 is low and as soon as the speed indicative signals presented to the positive input of comparator 83 exceeds the value of the signal presented to the negative input by resistor 87, the output of comparator 83 goes high. The output of comparator 83 is supplied via lead 88 to the comparator output node 82 as previously described.

Therefore, the combined operation of the low speed limit comparator 72 and the high speed limit comparator 83 is as follows. So long as the engine speed, as represented by the signal presented to input terminal 62, is within a predetermined band or range of speed, the output of comparators 72 and 83 is low. Alternatively, it may be said that so long as the engine speed is above the predetermined lower limit established by resistor 80 but below predetermined upper speed limit established by resistor 87, the output of both comparator 72 and comparator 83 will be low. So long as the engine speed operates within this band, the outputs of comparators 72 and 83 will both be low and as this low is transmitted from node 82 to the switching transistor control node 31 via diode 48 and lead 49, it will have no effect upon the operation of transistor 30 thereby maintaining it in its normally non-conductive state. This insures that the integrator circuitry of block 11 continues to operate in the closed loop control mode which is required within the speed range of 20 to 50 miles per hour, since within this range, the window near the stoichiometric air/fuel ratio is required to obtain maximum conversion of hydrocarbons, carbon monoxide and nitrous oxide simultaneously.

As previously described, when the vehicle is operating in rural areas at speeds above 50 miles per hour, the three way catalyst still has relatively good conversion of hydrocarbons and carbon monoxide and in rural areas the reduction of nitrous oxide emissions is no longer critical. Therefore, above 50 miles per hour it is desired that the electronic fuel injection system be operated in the open loop control mode so that the air/fuel ratio is set in the 16–18 to 1 range for the most efficient fuel economy.

The circuit of block 18 achieves this goal in the following manner. As the engine speed exceeds 50 miles an hour, as indicated by the fact that the speed indicative signal presented to terminal 62 and thence via resistor 84 to the positive terminal of comparator 83, exceeds the upper speed limit or threshold value established by resistor 87, the output of comparator 83 goes high. This high is transmitted via resistor 88, node 82, diode 48 and lead 49 to the switching transistor control node 31. The presence of a high at node 31 causes the switching transistor 30 to switch to a conductive state which switches the operation of the integrator circuitry of block 11 to the open loop control mode. In this mode, the output 24 of the integrator 11 is clamped to the predetermined level of voltage established by resistor 33 which is sufficient to operate the electronic fuel injection system of block 12 to achieve an air/fuel ratio in the range of 16–18 to 1 for optimum fuel efficeincy.

It has also been discovered that while the three way catalyst allows good conversion of hydrocarbons and carbon monoxide while operating in the open loop mode, the poor nitrous oxide conversion can be ignored below speeds of 20 miles an hour where engine load is low and little, if any, nitrous oxide emission occurs. Therefore, the vehicle can also be operated in a more fuel efficient open loop mode of operation below this speed. Therefore, when the engine speed falls below the predetermined lower limit established by resistor 80, the output of comparator 72 goes high. This high signal is transmitted via resistor 81, comparator output node 82, diode 48 and lead 49 to the switching transistor control node 31. The presence of a high at node 31 again switches transistor 30 to a conductive state so as to operate the integrator circuitry of block 11 in the more fuel efficient open loop control mode. The output of the integrator circuit of block 11 is again clamped to the predetermined voltage level established by resistor 33 which is sufficient to operate the electronic fuel injection system of block 12 in the non-stoichiometric relatively lean air/fuel ratio in the desired range such as 16–18 to 1, for example, for improved fuel economy.

As with the circuit of FIG. 2, the clamp override circuitry of block 19 can determine when the engine is accelerating to a point where a richer mixture is required for good drivability so as to turn on transistor 70 to disable the operation of the open loop control circuit of block 18, unclamp the output 24 of the integrator circuitry of block 11 and restore the closed loop control mode of operation regardless of engine speed. Therefore, the dual mode control circuitry of FIG. 3 offers an optimal system for controlling electronic fuel injection so that stringent governmental exhaust emission standards are met while balancing such standards with improved fuel economy and good drivability under most circumstances.

It will be understood that different speed ranges can be selected depending upon the type of engine, characteristics of the vehicle, nature of the catalyst, stringency of the emission standards, etc. Even as the emission standards change from year to year, the variable resistors associated with each of the comparators can be changed to alter thresholds if desired. Additionally, it will be appreciated that still other comparators can be added to the open loop control circuitry of block 18 to establish even more complex ranges of operation, and ranges could also be established for closed loop operation.

With this detailed description of the specific structure used to illustrate the preferred embodiments of the present invention and the operation thereof, it will be obvious to those skilled in the art that various modifications can be made in both the circuits and components of the dual mode control system of the present invention without departing from the spirit and scope thereof which is limited only by the appended claims.

We claim:

1. A dual mode hybrid control system for controlling the operation of an electronic fuel management system which regulates the air/fuel ratio of an internal combustion engine, the engine operable at different rotational speeds and having a catalytic converter for reducing exhaust gas emissions, said hybrid control system comprising:

means for generating an electrical signal for controlling the operation of said electronic fuel management system;

closed loop comparator means coupled to said signal-generating means for establishing a closed loop control mode for enabling said signal-generating means to normally operate said electronic fuel management system at air-fuel ratios within a conversion window of maximum efficiency for the converter while said engine operates within a predetermined range of driving speeds to achieve optimal reduction of engine emissions, said range of speeds including those engine conditions at which the level of NOx formation is detrimental and should be converted by said converter; and open loop comparator means coupled to said signal-generating means and responsive to the attainment of a driving speed outside of said predetermined range for switching to an open loop control mode for clamping the output of said signal-generating means to a predetermined air/fuel ratio value to operate said electronic fuel management system at a relatively lean air/fuel ratio not within said conversion window for improved fuel economy.

2. The dual mode hybrid control system of claim 1 further including means for sensing engine acceleration and means responsive to said engine acceleration having exceeded a predetermined limit for overriding said open loop control mode of operation and restoring said closed loop control mode of operation by unclamping the output of said signal-generating means to operate said electronic fuel management system at air/fuel ratios within said conversion window regardless of engine speed to achieve improved drivability over operation at said relatively lean air/fuel ratio.

3. The dual mode hybrid control system of claim 1 wherein said fuel management system includes a fuel injection system and said means for generating an electrical signal for controlling the operation of said electronic fuel injection system includes an electrical integrator circuit whose input is normally coupled to said closed loop comparator means, and whose output controls the operation of said electronic fuel injection system said integrator circuit further including means responsive to the output of said open loop comparator means for clamping the output of said integrator circuit to said predetermined air/fuel ratio value for operating said electronic fuel injection system at said predetermined relatively lean air/fuel ratio for improved fuel economy.

4. The dual mode hybrid control system of claim 1 wherein said closed loop comparator means includes means for sensing the quantity of oxygen in the engine exhaust and for generating an electrical signal indicative thereof and wherein said closed loop comparator means further includes a comparator having one input coupled to said oxygen sensing means and its other input coupled to a resistive means for establishing a reference level such that the output of said comparator goes high or low as the quantity of oxygen present in the engine exhaust increases and decreases on either side of said established reference level, the output of said comparator being coupled to the input of said means for generating an electrical signal for establishing a closed loop to control the operation of said electronic fuel injection system at a substantially stoichiometric air/fuel ratio for minimizing engine emissions.

5. The dual mode hybrid control system of claim 1 wherein said electrical signal-generating means comprises an electrical integrator circuit including an operational amplifier having first and second inputs and an integrator output, the output of said closed loop comparator means being coupled to the first input of said operational amplifier and resistive means for establishing said predetermined value of clamped voltage outputted during the open loop mode of operation being coupled to the second input of said operational amplifier, capacitive means being coupled between the first input of said operational amplifier and said integrator output, and a series combination including a resistor and a transistor switch being connected in parallel across said capacitive means such that the control electrode of said transistor switch is coupled to the output of said open loop comparator means to operate said switch for selectively clamping or unclamping the output of said integrator.

6. The dual mode hybrid control system of claim 5 further including means for sensing the quantity of oxygen present at the exhaust of said engine and for generating an electrical signal indicative thereof and wherein said closed loop comparator means includes a comparator having first and second inputs and a comparator output, the first comparator input being coupled to said means for generating electrical signals indicative of the quantity of oxygen present at said engine exhaust, the second comparator input being coupled to resistive means for establishing a reference level about which the oxygen level will vary for maintaining the stoichiometric air/fuel ratio during the closed loop mode operation, and said comparator output being coupled to the first input of said operational amplifier of said integrator circuit to complete a closed loop between the oxygen sensing means and the electronic fuel injection system.

7. A dual mode control circuit for controlling the operation of an electronic fuel injection system for an internal combustion engine operable at various engine speeds and having an engine exhaust with a catalytic converter for reducing emissions from said exhaust, said control circuit comprising:

integrator means whose output controls the operation of said electronic fuel injection system;

means for sensing the amount of oxygen present in the engine exhaust and generating an electrical signal indicative thereof;

first comparator means establishing a closed loop between said oxygen sensing means and said integrator means and responsive to said oxygen-indicative electrical signal for normally causing the output of said integrator means to vary as the quantity of oxygen in said engine exhaust varies so as to maintain an optimum air/fuel ratio window near stoichiometric for minimal engine emissions, said optimum air/fuel ratio being within the maximum conversion efficiency window of said converter;

speed sensing means for generating signals indicative of engine speed; and second comparator means coupled between said speed sensing means and said integrator means and responsive to said engine speed having exceeded a predetermined limit for clamping the output of said integrator means at a predetermined limit for clamping the output of said integrator means at a predetermined level effective to operate said fuel injection system at a predetermined, non-stoichiometric, relatively lean air/fuel ratio outside said conversion window for improved fuel economy, said predetermined limit corresponding to a driving speed where the conversion of the NOx component of the emissions of the engine exhaust is not critical to emission control.

8. A dual mode control circuit for controlling the operation of an electronic fuel injection system for an internal combustion engine operable at various engine speeds comprising and having a catalytic converter for the reduction of exhaust gas emissions:

closed loop means including an integrator whose output normally varies to maintain the operation of said electronic fuel injection system at near the stoichiometric air/fuel ratio which is within the window of maximum conversion efficiency for said converter; and means for establishing a range of driving speeds within which said closed loop means is operable to maintain said near stoichiometric air/fuel ratio to obtain optimal conversion of hydrocarbons, carbon monoxide and nitrous oxides, said range-establishing means being responsive to driving speeds outside of said range for clamping the output of said integrator in an open loop mode of operation to operate said electronic fuel injection system at a relatively lean air/fuel ratio for improved fuel economy since at speeds below said established range, hydrocarbons and carbon monoxide conversion is normally high and nitrous oxide emissions are negligible when engine loads are low and since at speeds above said established range nitrous oxide emissions are not usually critical in areas where high speed driving is permitted.

9. In an internal combustion engine operable at various rotational speeds and having an engine exhaust with a catalytic converter for the reduction of emissions and an electronic fuel injection system for controlling the quantity of fuel supplied to the engine, a dual mode control for operating the electronic fuel injection system comprising:

means for generating signals indicative of the oxygen present in the engine exhaust;

means coupled between said means for generating signals indicative of the oxygen present in the engine exhaust and said electronic fuel injection system for establishing a closed loop control mode of operation and including an integrator whose output varies as the oxygen in the engine exhaust varies for normally maintaining said engine operating at optimal emission-reducing air/fuel ratios near stoichiometric for maximum conversion efficiency of said converter;

means for generating signals indicative of the speed of the engine;

means coupled between said means for generating speed indicative signals and said integrator and responsive to the engine speed having passed a threshold corresponding to a predetermined driving speed for switching to an open loop mode of operation and clamping the output of said integrator to a predetermined value to operate said engine at a predetermined leaner air/fuel ratio for improved fuel economy;

means for generating a signal indicative of the acceleration of said engine; and means responsive to a predetermined acceleration for unclamping said integrator output and restoring said closed loop mode of operation.

10. A dual mode hybrid control system for controlling the operation of an electronic fuel management system which regulates the air/fuel ratio of an internal combustion engine, the engine operable at different rotational speeds and having a catalytic converter for reducing exhaust gas emissions, said hybrid control system comprising:

means for generating an electrical signal for controlling the operation of said electronic fuel management system;

means for generating electrical signals indicative of the speed of the engine;

closed loop comparator means coupled to said signal-generating means for establishing a closed loop control mode for enabling said signal-generating means to normally operate said electronic fuel management system at air-fuel ratios within a conversion window of maximum efficiency for the converter while said engine operates within a predetermined range of driving speeds to achieve optimal reduction of engine emissions, said range of speeds including those engine conditions at which the level of NOx formation is detrimental and should be converted by said converter;

open loop comparator means coupled to said signal-generating means and responsive to the attainment of a driving speed outside of said predetermined range for switching to an open loop control mode for clamping the output of said signal-generating means to a predetermined air/fuel ratio value to operate said electronic fuel management system at a relatively lean air/fuel ratio not within said conversion window for improved fuel economy; and said open loop comparator means including a comparator having first and second inputs and a comparator output, said first comparator input being coupled to means for establishing a predetermined threshold level indicative of a driving speed and said second input being coupled to said source of speed indicative signals such that the output of said comparator means will normally allow said signal-generating means to operate in said closed loop control mode so long as said engine speed is below said predetermined threshold level but will switch the operation of said signal-generating means to said predetermined value for effecting said relatively lean air/fuel ratio whenever said predetermined threshold level of driving speed has been exceeded.

11. A dual mode hybrid control system for controlling the operation of an electronic fuel management system which regulates the air/fuel ratio of an internal combustion engine, the engine operable at different rotational speeds and having a catalytic converter for reducing exhaust gas emissions, said hybrid control system comprising:

means for generating an electrical signal for controlling the operation of said electronic fuel management system;

means for generating electrical signals indicative of the speed of the engine;

closed loop comparator means coupled to said signal-generating means for establishing a closed loop control mode for enabling said signal-generating means to normally operate said electronic fuel management system at air-fuel ratios within a conversion window of maximum efficiency for the converter while said engine operates within a predetermined range of driving speeds to achieve optimal reduction of engine emissions, said range of speeds including these engine conditions at which the level of NOx formation is detrimental and should be converted by said converter;

open loop comparator means coupled to said signal-generating means and responsive to the attainment of a driving speed outside of said predetermined range for switching to an open loop control mode for clamping the output of said signal-generating means to a predetermined air/fuel ratio value to operate said electronic fuel management system at a relatively lean air/fuel ratio not within said conversion window for improved fuel economy; and said open loop comparator means including first and second comparators each having one input coupled to said source of speed indicative signals, the other input of one of said comparators being coupled to means for establishing a predetermined low speed driving threshold and the second input of the other of said comparators being coupled to means for establishing a predetermined high speed driving threshold such that so long as the engine operates between said low threshold and said high threshold, the outputs of said first and second comparators enable said signal-generating means to operate in said closed loop control mode, but whenever the engine speed falls below said low threshold or exceeds said high threshold of driving speed the output of one of said comparators switches said signal-generating means to operate in said open loop control mode by clamping the output of said signal-generating means to said predetermined value to operate said electronic fuel management system at said relatively lean air/fuel ratio.

12. A dual mode hybrid control system for controlling the operation of an electronic fuel management system which regulates the air/fuel ratio of an internal combustion engine, the engine operable at different rotational speeds and having a catalytic converter for reducing exhaust gas emissions, said hybrid control system comprising:

means for generating an electrical signal for controlling the operation of said electronic fuel management system;

means for generating electrical signals indicative of engine speed;

means for sensing the quantity of oxygen present at the exhaust of said engine and for generating an electrical signal indicative thereof;

closed loop comparator means coupled to said signal-generating means for establishing a closed loop control mode for enabling said signal-generating means to normally operate said electronic fuel management system at air-fuel ratios within a conversion window of maximum efficiency for the converter while said engine operates within a predetermined range of driving speeds to achieve optimal reduction of engine emissions, said range of speeds including those engine conditions at which the level of NOx formation is detrimental and should be converted by said converter;

open loop comparator means coupled to said signal-generating means and responsive to the attainment of a driving speed outside of said predetermined range for switching to an open loop control mode for clamping the output of said signal-generating means to a predetermined air/fuel ratio value to operate said electronic fuel management system at a relatively lean air/fuel ratio not within said conversion window for improved fuel economy;

wherein said electrical signal-generating means comprises an electrical integrator circuit including an operational amplifier having first and second inputs and an integrator output, the output of said closed loop comparator means being coupled to the first input of said operational amplifier and resistive means for establishing said predetermined value of clamped voltage outputted during the open loop mode of operation being coupled to the second input of said operational amplifier, capacitive means being coupled between the first input of said operational amplifier and said integrator output, and a series combination including a resistor and a transistor switch being connected in parallel across said capacitive means such that the control electrode of said transistor switch is coupled to the output of said open loop comparator means to operate said switch for selectively clamping or unclamping the output of said integrator;

wherein said closed loop comparator means includes a comparator having first and second inputs and a comparator output, the first comparator input being coupled to said means for generating electrical signals indicative of the quantity of oxygen present at said engine exhaust, the second comparator input being coupled to resistive means for establishing a reference level about which the oxygen level will vary for maintaining the stoichiometric air/fuel ratio during the closed loop mode operation, and said comparator output being coupled to the first input of said operational amplifier of said integrator circuit to complete a closed loop between the oxygen sensing means and the electronic fuel management system; and wherein said open loop comparator means includes a second comparator having first and second inputs and a comparator output, the first input of said second comparator being coupled to said means for generating speed indicative signals and the second input of said second comparator being coupled to resistive means for establishing a predetermined speed threshold below which the output of said second comparator will be maintained at a first value and above which the output of said second comparator will attain a second value, the output of said second comparator means being coupled to the control electrode of said switching transistor of said integrator circuit such that when the output of said second comparator means is in said first state, said switching transistor remains in a normally non-conductive state and said integrator circuit operates in said closed loop control mode, but when the output of said second comparator attains said second state said switching transistor is switched to a conductive state to clamp the output of said integrator circuit at said predetermined value established by the resistive means coupled to the second input of said operational amplifier thereby switching the operation of said integrator circuit to said open loop control mode to operate said electronic fuel management system to maintain said relatively lean air/fuel ratio.

13. The dual mode hybrid control system of claim 12 further including means for sensing engine acceleration and means responsive to said engine acceleration having attained a predetermined value for overriding said open loop control mode of operation, restoring said transistor switch to said normally non-conductive state and reverting to said closed loop control mode for maintaining the stoichiometric air/fuel ratio to improve drivability.

14. The dual mode hybrid control system of claim 12 further including an electronic circuit for differentiating said speedindicative signals to output a signal indicative of the acceleration of the engine, a third comparator having first and second inputs and a comparator output, the first comparator input of said third comparator being connected to the output of said differentiator circuit for receiving said signal indicative of the acceleration of said engine, the second comparator input of said third comparator being connected to resistive means for establishing a predetermined acceleration threshold such that said third comparator outputs a first signal when said engine acceleration is below said acceleration threshold level and a second switching signal when said engine acceleration exceeds said acceleration threshold level, and normally non-conductive switching means coupled between the trigger electrode of the switching transistor of said integrator circuit and ground and responsive to said second switching signal at the output of said third comparator means for switching to a conductive state and grounding the trigger electrode of said switching transistor of said integrator circuit whenever the engine acceleration exceeds said threshold value for overriding said open loop control mode of operation and unclamping the integrator output to restore the closed loop mode of operation.

15. A dual mode hybrid control system for controlling the operation of an electronic fuel management system which regulates the air/fuel ratio of an internal combustion engine, the engine operable at different rotational speeds and having a catalytic converter for reducing exhaust gas emissions, said hybrid control system comprising:

means for generating an electrical signal for controlling the operation of said electronic fuel management system;

means for generating electrical signals indicative of engine speed;

means for sensing the quantity of oxygen present at the exhaust of said engine and for generating an electrical signal indicative thereof;

closed loop comparator means coupled to said signal-generating means for establishing a closed loop control mode for enabling said signal-generating means to normally operate said electronic fuel management system at air-fuel ratios within a conversion window of maximum efficiency for the converter while said engine operates within a predetermined range of driving speeds to achieve optimal reduction of engine emissions, said range of speeds including those engine conditions at which the level of NOx formation is detrimental and should be converted by said converter;

open loop comparator means coupled to said signal-generating means and responsive to the attainment of a driving speed outside of said predetermined range for switching to an open loop control mode for clamping the output of said signal-generating means to a predetermined air/fuel ratio value to operate said electronic fuel management system at a relatively lean air/fuel ratio not within said conversion window for improved fuel economy;

wherein said electrical signal-generating means comprises an electrical integrator circuit including an operational amplifier having first and second inputs and an integrator output, the output of said closed loop comparator means being coupled to the first input of said operational amplifier and resistive means for establishing said predetermined value of clamped voltage outputted during the open loop mode of operation being coupled to the second input of said operational amplifier, capactive means being coupled between the first input of said operational amplifier and said integrator output, and a series combination including a resistor and a transistor switch being connected in parallel across said capacitive means such that the control electrode of said transistor switch is coupled to the output of said open loop comparator means to operate said switch for selectively clamping or unclamping the output of said integrator;

wherein said closed loop comparator means includes a comparator having first and second inputs and a comparator output, the first comparator input being coupled to said means for generating electrical signals indicative of the quantity of oxygen present at said engine exhaust, the second comparator input being coupled to resistive means for establishing a reference level about which the oxygen level will vary for maintaining the stoichiometric air/fuel ratio during the closed loop mode operation, and said comparator output being coupled to the first input of said operational amplifier of said integrator circuit to complete a closed loop between the oxygen sensing means and the electronic fuel management system; and wherein said open loop comparator means includes second and third comparators each having first and second inputs and a comparator output, the first input of each of said second and third comparators being coupled to said means for generating speed-indicative pulses, the second input of said second comparator being coupled to resistive means for establishing a predetermined low speed threshold, the second input of said third comparator being coupled to resistive means for establishing a predetermined high speed threshold, and the outputs of said second and third comparator being resistively coupled to the control electrode of said switching transistor of said integrator circuit such that when the speed of said engine is between said low speed threshold and said high speed threshold, the signal outputted from said second and third comparators will enable said integrator circuit to operate in said closed loop control mode, but when the engine speed falls below said low speed threshold or exceeds said high speed threshold the outputs from said second or third comparator will switch said switching transistor to a conductive state thereby operating said integrator circuit in said open loop control mode and clamping the output of said integrator circuit to said predetermined value to operate the electronic fuel management system at said relatively lean air/fuel ratio.

16. The dual mode hybrid control system of claim 15 further including means for sensing the acceleration of said engine and means responsive to said sensed acceleration having attained a predetermined value for overriding the operation of said second and third comparators to switch said integrator circuit from said open loop control mode of operation to said closed loop control mode of operation by switching off said switching transistor of said integrator to unclamp the integrator output and restore operation at the stoichiometric air/fuel ratio for improved drivability.

17. The dual mode hybrid control system of claim 15 further including differentiator means responsive to said speed indicative signals for outputting a signal indicative of the acceleration of said engine, a fourth comparator having a first input coupled to said source of acceleration indicative signal, a second input coupled to resistive means for establishing a predetermined acceleration threshold and a comparator output for generating a switching signal whenever the engine acceleration exceeds said predetermined acceleration threshold level, and switching means coupled between the trigger electrode of the switching transistor of said integrator circuit and ground for switching to a conductive state in response to the presence of said switching signal at the output of said fourth comparator to override the output of said second and third comparators and restore said switching transistor of said integrator circuit to a non-conductive state thereby restoring said integrator circuit to the closed loop control mode of operation and unclamping the integrator output to resume operating said electronic fuel injection system at the stoichiometric air/fuel ratio for improved drivability.

18. A dual mode control circuit for controlling the operation of an electronic fuel injection system for an internal combustion engine operable at various engine speeds and having an engine exhaust with a catalytic converter for reducing emissions from said exhaust, said control circuit comprising:

integrator means whose output controls the operation of said electronic fuel injection system;

means for sensing the amount of oxygen present in the engine exhaust and generating an electrical signal indicative thereof;

first comparator means establishing a closed loop between said oxygen sensing means and said integrator means and responsive to said oxygen-indicative electrical signal for normally causing the output of said integrator means to vary as the quantity of oxygen in said engine exhaust varies so as to maintain an optimum air/fuel ratio window near stoichiometric for minimal engine emissions, said optimum air/fuel ratio being within the maximum conversion efficiency window of said converter;

speed sensing means for generating signals indicative of engine speed;

second comparator means coupled between said speed sensing means and said integrator means, responsive to said engine speed having exceeded a predetermined limit for clamping the output of said integrator means at a predetermined level effective to operate said fuel injection system at a predetermined, non-stoichiometric, relatively lean air/fuel ratio outside said conversion window for improved fuel economy, said predetermined limit corresponding to a driving speed where the conversion of the NOx component of the emissions of the engine exhaust is not critical to emission control; and means responsive to a predetermined engine acceleration for disabling said second comparator means to unclamp the output of said integrator means and restore closed loop operation in said window near the stoichiometric air/fuel ratio.

19. The dual mode control circuit of claim 18 wherein said acceleration responsive means includes an electrical differentiator circuit having its input coupled to said means for generating signals indicative of the engine speed, a third comparator means having its first input coupled to the output of said electrical differentiator circuit and its second output coupled to variable resistor means for selecting a predetermined threshold level of acceleration such that said third comparator means will generate an override signal whenever the acceleration of said engine exceeds said predetermined acceleration threshold level, and switching means responsive to the presence of said override signal at the output of said third comparator means for overriding said second comparator means, unclamping the output of said integrator means and restoring closed loop control for improved drivability.

20. A dual mode control circuit for controlling the operation of an electronic fuel injection system for an internal combustion engine operable at various engine speeds and having an engine exhaust with a catalytic converter for reducing emissions from said exhaust, said control circuit comprising:

integrator means whose output controls the operation of said electronic fuel injection system;

means for sensing the amount of oxygen present in the engine exhaust and generating an electrical signal indicative thereof;

first comparator means establishing a closed loop between said oxygen sensing means and said integrator means and responsive to said oxygen-indicative electrical signal for normally causing the output of said integrator means to vary as the quantity of oxygen in said engine exhaust varies so as to maintain an optimum air/fuel ratio window near stoichiometric for minimal engine emissions, said optimum air/fuel ratio being within the maximum conversion efficiency window of said converter;

speed sensing means for generating signals indicative of engine speed;

second comparator means coupled between said speed sensing means and said integrator means, responsive to said engine speed having exceeded a predetermined limit, for clamping the output of said integrator means at a predetermined level effective to operate said fuel injection system at a predetermined, non-stoichiometric, relatively lean air/fuel ratio outside said conversion window for improved fuel economy, said predetermined limit corresponding to a driving speed where the conversion of the NOx component of the emissions of the engine exhaust is not critical to emission control; and wherein said integrator means includes an operational amplifier having one input coupled to the output of said first comparator means, a second input coupled to variable resistive means for selecting said predetermined level of voltage outputted from said integrator means when its output is clamped during open loop operation for determining said predetermined, non-stoichiometric, relatively lean air/fuel ratio for improved fuel economy and an integrator output for supplying control signals to operate said electronic fuel injection system, a capacitive means coupled between the first input of said operational amplifier and said integrator output, and a series path connected in parallel across said capactive means, said series path including a resistor and a switching transistor, said switching transistor having a control electrode coupled to the output of said second comparator means such that while said switching transistor is maintained in its normally non-conducting state, said integrator means operates in said closed loop mode to maintain said stoichiometric air/fuel ratio, but when said switching transistor is triggered to a conductive state, the output of said operational amplifier is clamped to a level determined by the resistive means at the second input of said operational amplifier to operate said integrator means in said open loop mode thereby operating said electronic fuel injection system at said predetermined non-stoichiometric relatively lean air/fuel ratio.

21. The dual mode control circuit of claim 20 wherein said second comparator means includes a comparator having its first input coupled to said means for generating signals indicative of the engine speed, its second input coupled to resistive means for selecting a predetermined threshold level of speed below which the output of said comparator is low and above which the output of said comparator is high, the output of said comparator being coupled to the trigger electrode of said switching transistor which is responsive to the presence of a low signal at the output of said comparator for maintaining said closed loop mode of operation but which is responsive to the presence of a high at the output of said comparator for switching said transistor to a conductive state thereby switching to said open loop mode of operation to clamp the integrator output of said operational amplifier to said predetermined level for operating said fuel injection system at said leaner non-stoichiometric air/fuel ratio.

22. The dual mode control circuit of claim 21 further including means for sensing engine acceleration, means responsive to said acceleration having attained a predetermined value for outputting an override signal and switching means coupled to the trigger electrode of said switching transistor and responsive to the presence of said override signal for completing a current path between said trigger electrode and ground to restore said switching transistor to its non-conductive state, restore said integrator means to said closed loop mode of operation and unclamp the integrator output of said operational amplifier regardless of the speed of said engine.

23. The dual mode control circuit of claim 21 further including an electrical differentiator circuit having one input coupled to the output of said means for generating signals indicative of engine speed, a second comarator having an input coupled to the output of said electrical differentiator and its other input coupled to resistive means for establishing a threshold level of acceleration such that said second comparator generates an override output signal whenever the engine acceleration exceeds said established acceleration threshold level, and normally non-conductive transistor switching means coupled between the trigger electrode of said switching transistor of said integrator means and ground and responsive to the presence of said override signal at the output of said second comparator for switching to a conductive state and completing a current path between said trigger electrode and ground for overriding the operation of said second comparator means and switching the switching transistor of said integrator means to a non-conductive state for restoring said integrator means to said closed loop mode of operation to unclamp the integrator output of said operational amplifier for improved drivability.

24. The dual mode control circuit of claim 20 wherein said second comparator means includes first and second comparators each having one comparator input coupled to said means for generating signals indicative of the engine speed, said first comparator having its second input coupled to resistive means for selectively determining a predetermined lower limit of engine speed and said second comparator having its second input coupled to resistive means for selectively determining a predetermined upper limit of engine speed, such that whenever the engine speed is between the lower speed limit determined by the resistive means at the second input of said first comparator and the upper speed limit determined by the resistive means at the second input of said second comparator, the outputs of said first and second comparators will be low enabling said trigger electrode to maintain said switching transistor in a non-conductive state to permit said integrator means to operate in said closed loop mode of operation but whenever the engine speed falls below said lower speed limit determined by the resistive means at the second input of said first comparator or exceeds the upper speed limit determined by the resistive means at the second input of said second comparator, the output of one of said first and second comparators goes high, said trigger electrode being responsive to the presence of a high at the output of one of said first and second comparators for switching said switching transistor to a conductive state to switch said integrator means to said open loop mode of operation and clamp the integrator output of said operational amplifier to said predetermined level for operating said fuel injection system at said relatively lean, non-stoichiometric, air/fuel ratio.

25. A dual mode control circuit for controlling the operation of an electronic fuel injection system for an internal combustion engine operable at various engine speeds comprising and having a catalytic converter for the reduction of exhaust gas emissions:

closed loop means including an integrator whose output normally varies to maintain the operation of said electronic fuel injection system at near the stoichiometric air/fuel ratio which is within the window of maximum conversion efficiency for said converter;

means for establishing a range of driving speeds within which said closed loop means is operable to maintain said near stoichiometric air/fuel ratio to obtain optimal conversion of hydrocarbons, carbon monoxide and nitrous oxides, said range-establishing means being responsive to driving speeds outside of said range for clamping the output of said integrator in an open loop mode of operation to operate said electronic fuel injection system at a relatively lean air/fuel ratio for improved fuel economy since at speeds below said established range, hydrocarbons and carbon monoxide conversion is normally high and nitrous oxide emissions are negligible when engine loads are low and since at speeds above said established range nitrous oxide emissions are not usually critical in areas where high speed driving is permitted; and wherein said means for establishing the range of driving speeds includes a first comparator having a first input coupled to said means for generating speed indicative signals, first threshold determining means for generating an electrical signal indicative of the predetermined low speed limit of said range coupled to the second input of said comparator such that the output of said first comparator will go "low" whenever the speed is above said predetermined low speed threshold limit established by said first threshold means and will go "high" whenever the speed drops below said low speed threshold level, a second comparator having a first input coupled to said means for generating speed indicative signals, a second threshold determining means for generating an electrical signal indicative of the predetermined high speed limit of speed range coupled to the second input of said second comparator such that the output of said second comparator will go "low" whenever the speed is below said predetermined high speed threshold limit established by said second threshold means and the output of said second comparator will go "high" whenever the speed exceeds said high speed threshold limit, means for coupling the outputs of said first and second comparators to said integrator, said integrator being responsive to the presence of a "low" signal for maintaining a closed loop mode of operation but being responsive to the presence of a "high" signal for switching to an open loop mode of operation and clamping the output of said integrator to a predetermined voltage for operating said electronic fuel injection system at a non-stoichiometric relatively lean air/fuel ratio in the range of from 15 to 1 to 19 to 1 for improved fuel economy.

26. The dual mode control circuit of claim 25 wherein said closed loop means includes the means for generating an electrical signal indicative of the variation from ideal emission-reducing stoichiometric air/fuel ratio operation, and wherein said integrator includes an operational amplifier having a first input coupled to the output of said means for generating variation indicative signals, capacitive means coupled between said first input of said operational amplifier and the integrator output, the series combination of a resistor and a transistor coupled in parallel across said capactive means, and means coupled to the second input of said operational amplifier for establishing a predetermined voltage level for establishing said a predetermined non-stoichiometric relatively lean air/fuel ratio in the range of from 15 to 1 to 19 to 1 for better fuel economy, the control electrode of said transistor being coupled to the outputs of said first and second comparators and being adapted for normally maintaining a non-conductive state so long as the output of said comparators is "low " thereby operating said integrator in said closed loop mode but being responsive to a "high" at the output of one of said first and second comparators for switching to a conductive state, shifting said integrator to an open loop mode of operation and clamping the output of said integrator at said predetermined voltage level.

27. The dual mode control circuit of claim 26 further including means for sensing the quantity of oxygen present in the exhaust of said engine, means for generating an electrical signal indicative of said sensed quantity of oxygen, a third comparator having one input coupled to said means for generating oxygen indicative signals, means for establishing a reference level indicative of the ideal level of oxygen required for optimal emission-reducing operation coupled to the second input of said third comparator such that the output of said third comparator is coupled to the first input of said operational amplifier to complete a closed loop between said oxygen sensing means and said electronic fuel injection system so as to operate said electronic fuel injection system in said closed loop mode at an optimal emission-reducing stoichiometric air/fuel ratio.

28. The dual mode control circuit of claim 26 further including means for sensing engine acceleration and means responsive to said engine acceleration having attained a predetermined value for unclamping the output of said integrator and restoring the closed loop mode of operation to operate said electronic fuel injection system at said optimal emission-reducing stoichiometric air/fuel ratio regardless of the vehicle speed.

29. The dual mode control circuit of claim 26 further including a differentiator having its input coupled to said means for generating speed indicative signals for generating an output indicative of the engine acceleration, a forth comparator having one input coupled to the output of said differentiator for generating an override signal whenever a predetermined value of engine acceleration has been attained and switching means responsive to the presence of said override signal at the output of said forth comparator for switching the transistor of said integrator to a non-conductive state to unclamp the output of said integrator and restoring a closed loop control mode to operate the electronic fuel injection system at said optimal emission-reducing stoichiometric air/fuel ratio regardless of vehicle speed for improved drivability.

* * * * *